US005490799A

United States Patent [19]

Yamamoto

[11] Patent Number: 5,490,799

[45] Date of Patent: Feb. 13, 1996

[54] CONNECTOR ASSEMBLY WITH ASSOCIATION INDICATOR

[75] Inventor: Masayuki Yamamoto, Shizuoka, Japan

[73] Assignee: Yazaki Corporation, Tokyo, Japan

[21] Appl. No.: 207,635

[22] Filed: Mar. 9, 1994

[30] Foreign Application Priority Data

Mar. 9, 1993 [JP] Japan ..... 5-047819

[51] Int. Cl.[6] ..... H01R 9/00

[52] U.S. Cl. ..... 439/489

[58] Field of Search ..... 439/488, 489, 439/350, 352, 353, 354, 359, 364; 411/8, 13, 14

[56] References Cited

U.S. PATENT DOCUMENTS

| | | | |
|---|---|---|---|
| 4,629,351 | 12/1986 | Kato et al. | 439/488 |
| 4,946,404 | 8/1990 | Takenarchi et al. | 439/352 |
| 5,041,017 | 8/1991 | Nakazato et al. | 439/352 |
| 5,195,900 | 3/1993 | Kumagai et al. | 439/364 |

FOREIGN PATENT DOCUMENTS 61-4179 10/1986 Japan .

*Primary Examiner*—Gary F. Paumen
*Assistant Examiner*—Hien D. Vu
*Attorney, Agent, or Firm*—Wigman, Cohen, Leitner & Myers

[57] ABSTRACT

Disclosed is a connector assembly with an association indicator. The association indicator comprises: an indicator opening provided on the female connector housing; a movable member having an indicator member and being movably arranged inside the female connector housing; moving means for moving the movable member according to insertion of the male connector housing into the female connector housing; guide means for guiding the indicator member to the indicator opening according as the movable member is moved in such a manner that the indicator member appears in the indicator opening only when said pair of electrical terminals are associated; and prevention means for preventing the indicator member from being excessively inserted into the indicator opening to pass a predetermined position in the indicator opening, when excessive force such as to force the indicator member to pass the predetermined position is exerted on the indicator member by insertion of the male connector housing.

20 Claims, 3 Drawing Sheets

CONNECTOR ASSEMBLY WITH ASSOCIATION INDICATOR

BACKGROUND OF THE INVENTION

1. Field of the Invention

The present invention relates to an association indicator for a connector assembly and a connector assembly provided with an association indicator, comprising a female connector and a male connector which is to be inserted into the female connector for making an electrical connection, and in particular, to an association indicator and a connector assembly with an association indicator in which non-visible association of the inserted male connector with the female connector at the inside of the female connector can be indicated to the naked eye.

2. Description of the Prior Art

A connector assembly is composed of a female connector and a male connector which is to be inserted into the female connector for making an electrical connection. During the insertion operation, the male connector is hidden inside the female connector, and it is therefore impossible to detect whether the male connector has reached the position at which the contact portion of the male connector associates with the corresponding contact portion of the female connector. This often results in damage of the contact portion or other parts due to excessive force loaded onto the connector assembly.

For solving the above problem, Japanese Laid-Open Patent Publication No.(kohkai) 61-4179 discloses an association indicator of a connector assembly, which is also shown in FIGS. 1 to 3 accompanying the present application. In this connector assembly, the male connector A and the female connector B, after insertion of the male connector A, are fastened by a bolt B1 which passes through an axial hollow member C for supporting the axial bolt B1, and the association indicator D is provided at the inside of the axial hollow member C of the female connector B. The association indicator D comprises an indicator rod D1 which is made of synthetic resin and arranged in an axially extended recess D2 so that the indicator rod D1 can move axially in the same direction as the male connector A is moved relative to the female connector B in response to the motion of insertion. The recess D2 is tapered at one end and formed with an indicator window D3. At the same side, the indicator rod D1 is divided into two indication portions D4 with a space D5 therebetween.

According to the above structure, in response to insertion of the male connector A into the female connector B, the indicator rod D1 is pushed against a meeting surface A1 of the male connector A and moved to the tapered surface D6. The indicator portions D4 are then thrusted into the indicator window D3 and bent as shown in FIG. 3, so that the ends of the indicator portions D4 appear in the indicator window D3 only when the male and female connectors associate. As a result, association of the male and female connectors can be signified by appearance of the indicator portions D4 in the indicator window D3. If the male connector A is removed from the female connector B, the indicator portions D4 of the indicator rod D1 are released from the indicator window D3 by elastic force which acts to restore the bent indicator portions D4 to their original states.

However, if the indicator rod D1 is slightly longer or the insertion distance of the connector assembly is varied due to dimensional variations produced during manufacture of the assembly parts, the indicator portions D4 are often too deeply thrusted into the indicator window D3 so that a state depicted by a broken line D4' occurs. As a result, the indicator portions D4 are caught at the window D3 and they are incapable of being released from the indicator window D3 to return to the original position. Accordingly, when the connector assembly is reassembled, the connector assembly is often found damaged due to an inoperative indicator.

SUMMARY OF THE INVENTION

Therefore, it is an object of the present invention to provide an association indicator for a connector assembly, which is capable of reliably indicating association and disassociation of the male and female connectors.

Moreover, it is another object of the present invention to provide a connector assembly provided with an association indicator in which the contact parts can be prevented from being damaged by utilizing an association indicator with a high level of accuracy.

In order to achieve the above-mentioned object, in use for a connector assembly comprising a pair of male and female connector housings, in which at least a pair of electrical terminals are separately provided on each of the male and female connector housings and the male connector housing is adapted for insertion into the female connector housing so as to make electrical connection by association of said pair of electric terminals, an association indicator for indicating association of said pair of electrical terminals, according to the present invention, comprises: an indicator opening provided on the female connector housing; a movable member having an indicator member and being movably arranged inside the female connector housing; moving means for moving the movable member according to insertion of the male connector housing into the female connector housing; guide means for guiding the indicator member to the indicator opening according as the movable member is moved, in such a manner that the indicator member appears in the indicator opening only when said pair of electrical terminals are associated; and prevention means for preventing the indicator member from being excessively inserted into the indicator opening to pass a predetermined position in the indicator opening, when excessive force such as to force the indicator member to pass the predetermined position is exerted on the indicator member by insertion of the male connector housing.

Moreover, a connector assembly according to the present invention comprises: a pair of male and female connector housings, in which at least a pair of electrical terminals are separately provided on each of the male and female connector housings and the male connector housing is adapted for insertion into the female connector housing so as to make electrical connection by association of said pair of electric terminals; and an association indicator for indicating association of said pair of electrical terminals, the association indicator comprising: an indicator opening provided on the female connector housing; a movable member having an indicator member and being movably arranged inside the female connector housing; moving means for moving the movable member according to insertion of the male connector housing into the female connector housing; guide means for guiding the indicator member to the indicator opening according as the movable member is moved, in such a manner that the indicator member appears in the indicator opening only when said pair of electrical terminals are associated; and prevention means for preventing the indicator member from being excessively inserted into the indicator opening to pass a predetermined position in the indicator opening, when excessive force such as to force the indicator member to pass the predetermined position is exerted on the indicator member by insertion of the male connector housing.

in the above construction, the prevention means includes an absorber for absorbing said excessive force, or stopper means for forcefully stopping the indicator member at the predetermined position against said excessive force.

With the above-mentioned structure, even when a member for indication is slightly longer or the insertion distance of the connector assembly is varied due to dimensional variations produced during manufacture of the assembly parts, the member for indication can be prevented from being caught at the indication opening.

BRIEF DESCRIPTION OF THE DRAWINGS

The features and advantages of the association indicator of the connector assembly according to the present invention will be more clearly understood from the following description of the preferred embodiments of the present invention taken in conjunction with the accompanying drawings in which identical reference numerals designate the same or similar elements or sections throughout the figures thereof and in which.

DETAILED DESCRIPTION OF THE PREFERRED EMBODIMENTS

Figure 1:
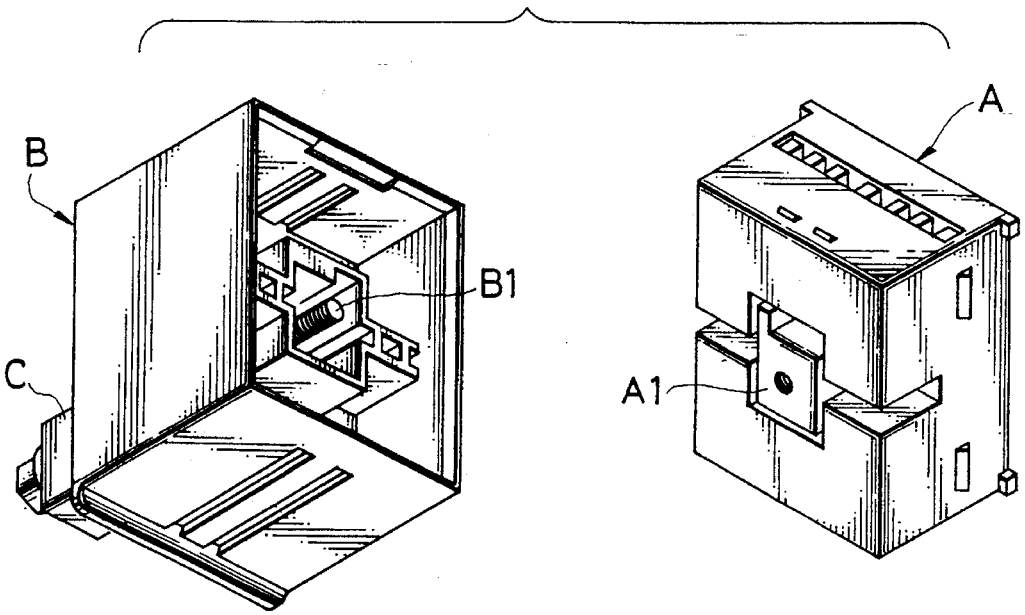
FIG. 1 PRIOR ART
FIG. 1 is a perspective view showing a conventional connector assembly.
Figure 2:
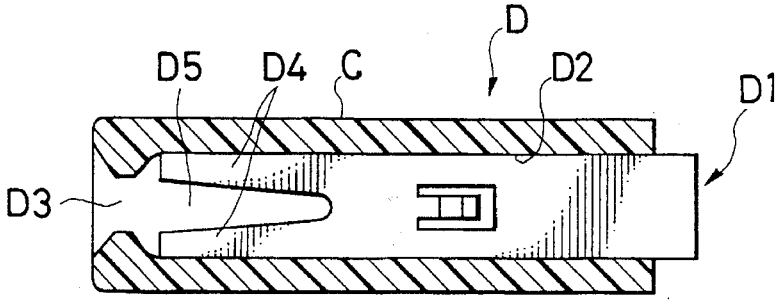
FIG. 2 PRIOR ART
FIG. 2 is a sectional view of a conventional association indicator provided on the connector assembly as illustrated in FIG. 1.
Figure 3:
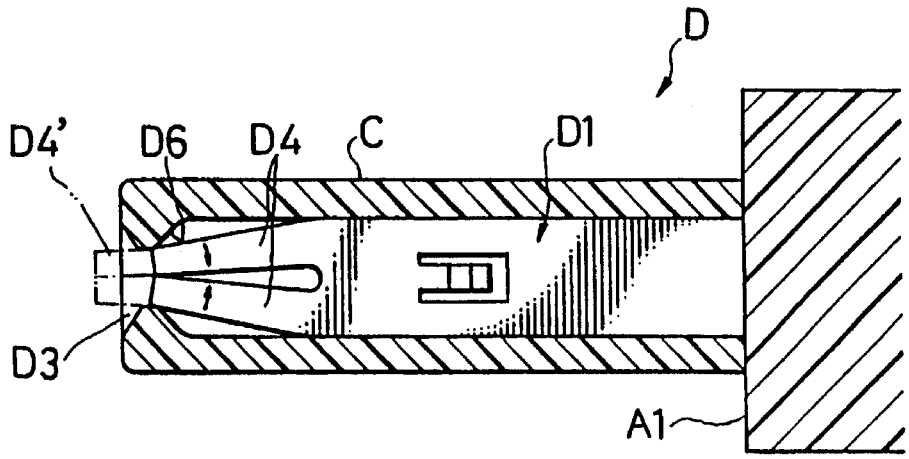
FIG. 3 PRIOR ART
FIG. 3 is a sectional view for explanation of the indication operation of the conventional association indicator of FIG. 2.

Referring now to the drawings, a preferred embodiment of the association indicator of the connector assembly according to the present invention will be explained.

Figure 4:
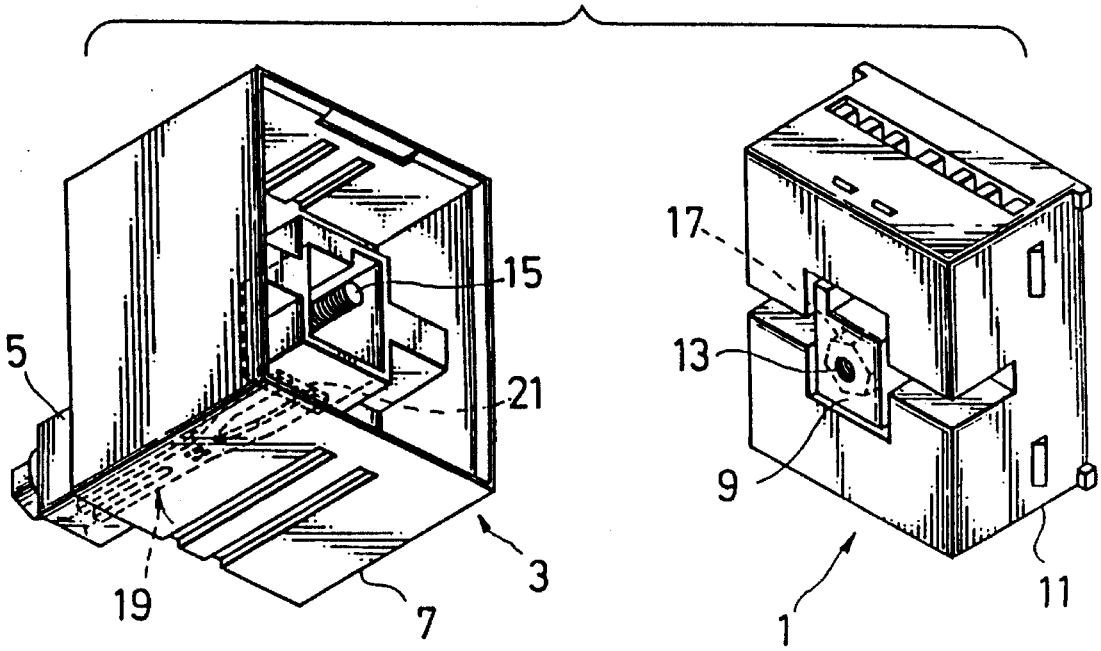
FIG. 4 is a perspective view showing a connector assembly provided with an association indicator according to the present invention.

FIG. 4 shows a box-shaped connector assembly with an association indicator. The connector assembly comprises a male connector 1 and a female connector 8, and an elongated hollow member 5 having a box shape, which axially penetrates the housing 7 of the female connector 3. As for the male connector 1, a thrust surface 9 is formed at the axial center of the housing 11 of the male connector 1 so that, when the male connector 1 is inserted into the female connector 3, the thrust surface slides into the hollow member 5. A center hole 13 is formed on the thrust surface 9. In order to fasten the male connector 1 to the female connector 3, a bolt 15 is axially passed through the hollow member 5 and the housing 11 and it is then screwed into a nut 17 at the reverse side of the thrust surface. The housings 7, 11 and the hollow member 5 are made of synthetic resin.

Figure 5:
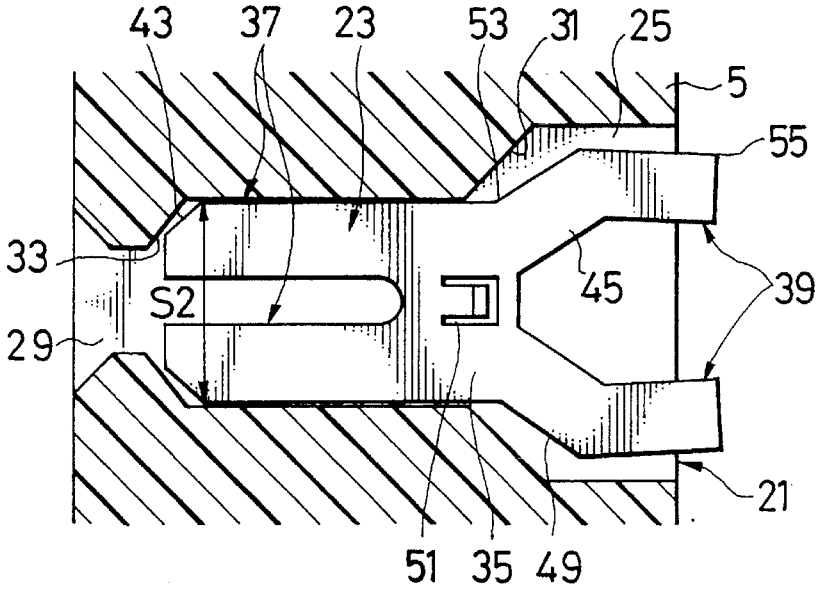
FIG. 5 is a sectional view showing the association indicator illustrated in FIG. 4.
Figure 6:
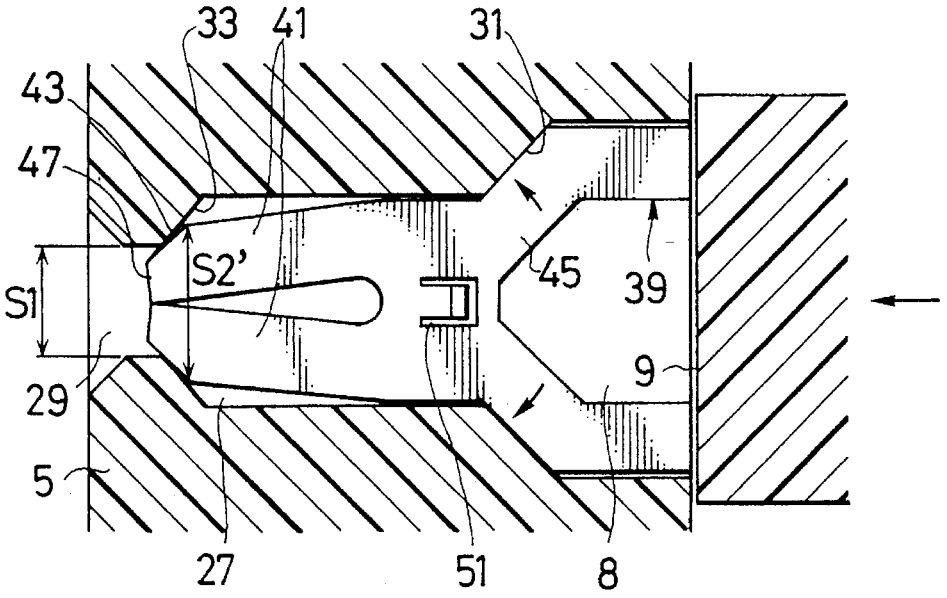
FIG. 6 is a sectional view for explanation of the indication operation of the association indicator of FIG. 5.

As shown in FIGS. 4 and 5, the association indicator 19, according to the present invention, comprises a thin guide recess 21 formed at the inside of the female connector 3 and a thin and flat slide plate 23 being supported by the guide recess 21 so that the slide plate 23 can be axially moved in the guide recess 21. The details of the association indicator 19 are shown in FIGS. 5 and 6. In FIG. 5, the guide recess 21 is formed inside the hollow member 5 and the slide plate 23 resides in the guide recess 21 in such a manner that the slide plate 23 can slide in the guide recess 23 along the axial direction of the female connector 3.

The guide recess 21 extends in the axial direction in 30 the female connector 3 from the inside of the housing 7 to the outside along the hollow member 5. The guide recess 21 includes a first space 25, a second space 27 and an indicator window 29, each of which has a constant width, respectively. The width of the first space 25 is larger than that of the second space 27, and the width of the guide recess 21 is gradually and symmetrically narrowed along the axial direction by a pair of straight and slant surfaces 31 at the location between the first and second spaces 25 and 27. Moreover, the width of the second space 27 is larger than the width S1 of the indicator window 29, and the guide recess 21 is further tapered by a pair of straight and slant guide surfaces 33 at the location between the second spaces 27 and the indicator window 29. The indicator window 29 is enlarged toward the outside of the hollow member 5.

The slide plate 23 includes a body portion 35, an indicator portion 37 and an absorber portion 39 which are integrally formed of a flexible synthetic resin. In detail, the indicator portion 37 is composed of a pair of arms 41 which are parallel to each other and extend from the body 35. Each of the arms 41 is tapered by a slant surface 43 at the terminal end thereof. The absorber portion 39 is composed of a pair of legs 45. Each of the legs 45 extends from the body 35 separated from each other, and they are then bent again at the intermediate portion thereof so that the legs are slightly bent toward each other.

When the male connector 1 is inserted into the female connector 3, the thrust surface 9 is inserted by sliding it into the hollow member 5, which pushes the legs 45 of the slide plate 23 into the guide recess 21. Due to this action, the slide plate 23 moves in the axial direction according to insertion of the male connector 1 and the tip ends of the arms 41 are pushed against the slant guide surfaces 33 of the guide recess 23 thereby sliding into the indicator window 29, with the arms 41 elastically bent toward each other. That is, the tip ends of the arms 41 are guided to the indicator window 29 according as the body portion 35 axially moves toward the indicator window 29. Then, when the electrical terminals (not shown) of the male and female connectors 1 and 3 are associated and electrical connection is achieved, the thrust surface 9 abuts the hollow member 5. At this time, end faces 47 of the arms 41 are in contact with each other and appear in the indicator window 29. As a result, association of the electrical terminals can be detected by the appearance of the end faces 47 in the indicator window 29. Moreover, while the ends of the arms 41 are thrusted into the indicator window 29, the legs 45 are forced to be elastically expanded and the outer slant surfaces 49 of the legs 45 abut on the slant surfaces 31 of the guide recess 21. Therefore, the slide plate 23 is inhibited from being further moved into the indicator window 29.

While the male and female connectors are coupled, the slant surfaces 43 of the arms 41 are elastically pushed against the slant surfaces 33 of the guide recess 21 by a restoration force which acts on the bent arms 41 such as to restore the arms to the original and straight state. Then, if the male connector 1 is pulled away from the female connector 3 (i.e. during disconnection) and the thrust surface leaves the hollow member 5, the arms 41 are pushed back by the restoration force of the arms 41 and released from the indicator window 29. At the same time, the slide plate 23 moves away from the indicator window 29 in the axial direction, and the end faces 47 disappear from the indicator window 29 behind the slant surfaces 33. The body portion 35 of the slide plate 23 has a flexible stopper 51 for preventing the slide plate 23 from coming out of the guide recess 21.

In the above-described embodiment, some of the features of the association Indicator have been improved. These modifications were performed to insure the indication operation of the slide plate 23 is reliably achieved. 30 firstly, the width S2 of the slide plate at the arms 41 extending straight in the natural state is determined so that the width S2' of the slide plate when the arms 41 are elastically bent and contacting with each other as shown in FIG. 6 is larger than the width S1 of the indicator window 29. According to this structure, the tip portions of the arms 41 can be prevented from being excessively inserted into the indicator window 29 thus being caught therein.

Secondly, the angles of inclination of the slant surfaces 43 of the arms 41 in the natural state which is shown in FIG. 5 do not correspond to those of the slant surfaces 33 of the guide recess 21. When the slide plate 23 is pushed by the thrust surface 9, the edges between the slant surfaces 43 and end faces 47 first abuts on the slant surface 33. Therefore, the counter force against the arms 41 is concentrated on the initial contact surfaces of the arms 41, so that the arms 41 are efficiently bent by the counter force. Then, the angle of inclination of the slant surfaces 43 become approximately equal to the angle of inclination of the slant surfaces 33 when the arms 41 bend toward each other and the end faces 47 appear in the indicator window 29. Therefore, the slant surfaces 43 of the bent arms 41 contact face to face with the guide recess 21 during connection of the male and female connectors. This is advantageous in that it is possible to prevent the surface of the guide recess 21 from being damaged by pressing a sharp edge thereto for a long time.

Thirdly, each of the bent legs 45 of the slide plate 23 has an outer slant surface to abut on the slant surface 31 of the guide recess 21 against the thrust force. Due to this structure, the bent legs 45 prevent the slide plate 23 from moving axially beyond a predetermined position toward the indicator window 29. Namely, the arms 41 are prevented from being inserted too deeply into the indicator window 29 by appropriately regulating the length between the roots 53 of the legs 45 and the tip ends of the arms 41. Moreover, angles of inclination of the outer slant surfaces 49 do not correspond to those of the slant surfaces 31 in the original state of FIG. 5, but correspond to those angles when the slide plate is pushed by the thrust surface 9. This is due to the structure in which the rear ends of the legs 45 are slanted so that the thrust force is first applied to the outer edges of the leg ends, which works to open the legs 45. Therefore, if the thrust surface 9 leaves the guide recess 21, the bent legs 45 return to their original state so as not to contact the surfaces of the guide recess 21. As a result, the legs 45 do not inhibit the "slide-back" motion of the slide plate 23.

Fourthly, the legs 45 of the slide plate 23 are bent twice and flexible so that they can be made short in the longitudinal direction. These legs 45 work as a buffer or absorber for absorbing the thrust force by elastically shrinking in the longitudinal direction and appropriately adjusting the longitudinal length of the slide plate 23 to that of the guide recess 21 so that the tip ends of the arms 41 may not be thrusted too deeply into the indicator window, even when the slide plate is manufactured slightly longer than a desired length. Here, it is to be noted that the essence of the fourth feature is to give an adjustable portion to the slide plate 23. In other words, this feature can be realized in another way. For example, a zigzag plate spring, a cushion pad and the like can be used as a buffer in place of said pair of bent legs 45. Therefore, it is also possible to change the guide recess so as to omit the slant surfaces 31 and make the width of the first space 25 uniform with that of the second space 27.

According to the above-described construction, when excessive force such as to force the indicator member to pass a predetermined position of the indicator window is exerted on the indicator member by insertion of the male connector housing, the indicator member can be prevented from being excessively inserted into the indicator opening to pass the predetermined position. As a result, the association indicator for a connector assembly is capable of reliably indicating association and disassociation of the male and female connectors.

In the above-described embodiment, association of the electrical terminals is indicated by the end faces 47 of the arms 41. When the connector assembly is disconnected, the end faces 47 are hidden behind the slant surfaces 33. If it is desired to make the indication difference between the appearance and disappearance of the end faces 47 more clear, it can be accomplished by making uniform the distance between the inside edges of the arms 41 in the natural state and the width S1 of the indicator window 29 uniform.

In the foregoing embodiment, the association indicator is provided along the hollow member on the bolt-fixation type connector assembly. However, the association indicator may be provided along a side wall of the female connector housing, and the present invention is also applicable to various types of connectors other than the bolt-fixation type.

Moreover, it is also possible to use a plurality of guide pins being aligned inside the female connector housing so as to support the motion of slide plate, in place of the guide recess formed on the hollow member.

As mentioned above, it must be understood that the invention is in no way limited to the above embodiment and that many changes may be brought about therein without departing from the scope of the invention as defined by the appended claims.

What is claimed is:

1. An association indicator for a connector assembly comprising a pair of male and female connector housings, in which at least a pair of electrical terminals are separately provided on each of the male and female connector housings and the male connector housing is adapted for insertion into the female connector housing so as to make electrical connection by association of said pair of electric terminals, the association indicator, for indicating association of said pair of electrical terminals comprising:

an indicator opening provided in the female connector housing;

a movable member having an indicator member at a forward end thereof and being movably arranged inside the female connector housing;

means for moving the movable member during insertion of the male connector housing into the female connector housing;

means for guiding the indicator member to the indicator opening as the movable member is moved, in such a manner that the indicator member appears in the indicator opening only when said pair of electrical terminals are mated; and prevention means for absorbing an excessive force applied to the movable member, the prevention means extending from the movable member at a rear end thereof and engaging with the female connector housing, preventing the indicator member from being inserted into the indicator opening past a predetermined position in the indicator opening.

2. The association indicator of claim 1, wherein the prevention means includes an absorber for absorbing said excessive force.

3. The association indicator of claim 1, wherein the absorber includes an elastic member provided on the movable member for absorbing a component of the excess force which is exerted on the movable member from the moving means, to control the movement of the movable member so that the movable member moves within a predetermined range.

4. The association indicator of claim 3, wherein the elastic member is a bent leg comprising a flexible material.

5. The association indicator of claim 1, wherein the prevention means includes a stop means for stopping the indicator member at the predetermined position against said excessive force.

6. The association indicator of claim 2, wherein the prevention means further includes a stop means for stopping the indicator member at the predetermined position against said excessive force.

7. The association indicator of claim 6, wherein the movable member is arranged so as to move toward the indicator opening by insertion of the male connector housing, the guide means including a slant surface provided adjacent to the indicator opening on the female connector housing and a flexible arm which extends from the movable member and has an end directed to the slant surface, wherein the flexible arm abuts the slant surface and elastically bends when the male connector housing is inserted to guide said end of the flexible arm device into the indicator opening, and the indicator member includes an indication face provided on said end of the flexible arm device.

8. The association indicator of claim 7, wherein the stop means is improved width relationship between the flexible arm device and the indicator opening such that the indicator opening is so narrow that the flexible arm device could not be completely inserted into the indicator opening.

9. The association indicator of claim 7, wherein each of the slant surface, the flexible arm device and the indication face is formed into a pair symmetrically.

10. An association indicator for a connector assembly comprising a pair of male and female connector housings, in which at least a pair of electrical terminals are separately provided on each of the male and female connector housings and the male connector housing is adapted for insertion into the female connector housing so as to make electrical connection by association of said pair of electric terminals, the association indicator, for indicating association of said pair of electrical terminals, comprising:

an indicator opening provided in the female connector housing;

a movable member having an indicator member and being movably arranged inside the female connector housing;

means for moving the movable member during insertion of the male connector housing into the female connector housing;

means for guiding the indicator member to the indicator opening as the movable member is moved, in such a manner that the indicator member appears in the indicator opening only when said pair of electrical terminals are mated; and means for preventing the indicator member from being inserted into the indicator opening past a predetermined position in the indicator opening under an excessive force;

wherein the prevention means includes an absorber for absorbing said excessive force, the prevention means further includes means for stopping the indicator member at the predetermined position against said excessive force, the movable member being arranged so as to move toward the indicator opening by insertion of the male connector housing, the guide means including a first slant surface provided adjacent to the indicator opening on the female connector housing and a flexible arm which extends from the movable member and has an end directed to the first slant surface, wherein the flexible arm abuts the slant surface and elastically bends when the male connector housing is inserted to guide said end of the flexible arm device into the indicator opening, and the indicator member is an indication face provided on said end of the flexible arm device; and wherein the flexible arm device has a second slant surface in which inclination of the second slant surface of the flexible arm corresponds substantially to the inclination of the first slant surface of the female connector housing during movement of the movable member toward the indicator opening.

11. The association indicator of claim 6, wherein the prevention means further includes an abutting surface formed on the movable member and a receiving surface provided on the female connector housing for receiving the abutting surface to inhibit the movable member from moving out of a predetermined range.

12. A connector assembly comprising:

a pair of male and female connector housings, in which at least a pair of electrical terminals are separately provided on each of the male and female connector housings and the male connector housing is adapted for insertion into the female connector housing so as to make electrical connection by association of said pair of electric terminals; and an association indicator for indicating association of said pair of electrical terminals, the association indicator comprising:

an indicator opening provided on the female connector housing;

a movable member having an indicator member at a forward end thereof and being movably arranged inside the female connector housing;

means for moving the movable member during insertion of the male connector housing into the female connector housing;

means for guiding the indicator member to the indicator opening as the movable member is moved, in such a manner that the indicator member appears in the indicator opening only when said pair of electrical terminals are mated; and prevention means for absorbing an excessive force applied to the movable member, the prevention means extending from the movable member at a rear end thereof and engaging with the female connector housing, preventing the indicator member from being inserted into the indicator opening past a predetermined position in the indicator opening under an excessive force applied to the indicator member by insertion of the male connector housing.

13. The connector assembly of claim 12, wherein the prevention means includes an absorber for absorbing said excessive force.

14. The connector assembly of claim 12, wherein the absorber includes an elastic member provided on the movable member for absorbing a component of the excess force which is exerted on the movable member from the moving means, to control the movement of the movable member so that the movable member moves within a predetermined range.

15. The connector assembly of claim 12, wherein the prevention means includes a stop means for stopping the indicator member at the predetermined position against said excessive force.

16. The connector assembly of claim 13, wherein the prevention means further includes a stop means for stopping the indicator member at the predetermined position against said excessive force.

17. The connector assembly of claim 16, wherein the movable member is arranged so as to move toward the indicator opening by insertion of the male connector housing, the guide means including a slant surface provided adjacent to the indicator opening on the female connector housing and a flexible arm which extends from the movable member and has an end directed to the slant surface, wherein the flexible arm abuts the slant surface and elastically bends when the male connector housing is inserted to guide said end of the flexible arm device into the indicator opening, and the indicator member includes an indication face provided on said end of the flexible arm device.

18. The connector assembly of claim 17, wherein the stopper means is improved width relationship between the flexible arm device and the indicator opening such that the indicator opening is so narrow that the flexible arm device could not be completely inserted into the indicator opening.

19. The connector assembly of claim 17, wherein each of the slant surface, the flexible arm device and the indication face is formed into a pair symmetrically.

20. A connector assembly comprising;

a pair of male and female connector housings, in which at least a pair of electrical terminals are separately provided on each of the male and female connector housings and the male connector housing is adapted for insertion into the female connector housing so as to make electrical connection by association of said pair of electric terminals; and an association indicator for indicating association of said pair of electrical terminals, the association indicator comprising;

an indicator opening provided on the female connector housing;

a movable member having an indicator member and being movably arranged inside the female connector housing;

means for moving the movable member during insertion of the male connector housing into the female connector housing;

means for guiding the indicator member to the indicator opening as the movable member is moved, in such a manner that the indicator member appears in the indicator opening only when said pair of electrical terminals are mated; and means for preventing the indicator member from being inserted into the indicator opening past a predetermined position in the indicator opening under an excessive force applied to the indicator member by insertion of the male connector housing;

wherein the prevention means includes an absorber for absorbing said excessive force, the prevention means further including a stop means for stopping the indicator member at the predetermined position against said excessive force, the movable member being arranged so as to move toward the indicator opening by insertion of the male connector housing, the guide means including a first slant surface provided adjacent to the indicator opening on the female connector housing and a flexible arm which extends from the movable member and has an end directed to the first slant surface such that the flexible arm abuts the first slant surface and elastically bends when the male connector housing is inserted to guide said end of the flexible arm into the indicator opening, the indicator member including an indication face provided on said end of the flexible arm device; and wherein the flexible arm device has a second slant surface in which inclination of the second slant surface of the flexible arm corresponds substantially to the inclination of the first slant surface of the female connector housing during movement of the movable member toward the indicator opening.

* * * * *